US007538757B2

(12) United States Patent
Zhou et al.

(10) Patent No.: US 7,538,757 B2
(45) Date of Patent: May 26, 2009

(54) TEMPERATURE DEPENDENT ELECTROPHORETIC PRESET PULSE

(75) Inventors: Guofu Zhou, Best (NL); Mark T. Johnson, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 533 days.

(21) Appl. No.: 10/557,683

(22) PCT Filed: May 17, 2004

(86) PCT No.: PCT/IB2004/001700

§ 371 (c)(1),
(2), (4) Date: Nov. 22, 2005

(87) PCT Pub. No.: WO2004/104977

PCT Pub. Date: Dec. 2, 2004

(65) Prior Publication Data

US 2007/0052665 A1 Mar. 8, 2007

Related U.S. Application Data

(60) Provisional application No. 60/473,208, filed on May 23, 2003.

(51) Int. Cl.
*G09G 3/34* (2006.01)

(52) U.S. Cl. ..... 345/107; 359/296

(58) Field of Classification Search ..... 345/107, 345/696, 204–205, 690; 359/296
See application file for complete search history.

(56) References Cited

U.S. PATENT DOCUMENTS

| | | | | |
|---|---|---|---|---|
| 6,064,410 | A * | 5/2000 | Wen et al. | 347/111 |
| 7,012,600 | B2 * | 3/2006 | Zehner et al. | 345/214 |
| 7,126,577 | B2 * | 10/2006 | Zhou et al. | 345/107 |
| 7,126,743 | B2 * | 10/2006 | Johnson et al. | 359/296 |
| 2005/0001812 | A1 * | 1/2005 | Amundson et al. | 345/107 |
| 2006/0291122 | A1 * | 12/2006 | Zhou et al. | 361/103 |

* cited by examiner

*Primary Examiner*—Richard Hjerpe
*Assistant Examiner*—Jason M Mandeville

(57) ABSTRACT

A display device (1) has electrophoretic particles (8, 9), a display element including electrodes (5, 6), between which a portion of the electrophoretic particles (8, 9) is present, a temperature sensor (25) and a processor (15) for supplying a driving pulse (32) to the electrodes (5, 6) to bring the display element to a predetermined black, gray or white state, corresponding to the image information to be displayed. For improved grayscale accuracy and optimal picture and text quality, the processor (15) is further arranged to supply pre-pulses (31) preceding the driving pulses (32). The energy of the pre-pulses (31) is increased with increased temperature measured by the temperature sensor (25) and is sufficient to release the electrophoretic particles at a first position near one of the two electrodes (5, 6), but too low to enable the particles to reach a second position near the other electrode (5 or 6).

32 Claims, 6 Drawing Sheets

TEMPERATURE DEPENDENT ELECTROPHORETIC PRESET PULSE

This application is a 371 of PCT/IB04/01700, filed 17 May 2004, which claims the benefit of U.S. Provisional Application No. 60/473,208, filed 23 May 2003.

The invention relates to a display device comprising electrophoretic particles, a display element comprising a pixel electrode and an associated counter electrode, between which a portion of the electrophoretic particles is present, and control means for supplying a drive signal to the electrodes to bring the display element to a predetermined optical state corresponding to the image information to be displayed.

Display devices of this type are used, for example, in monitors, laptop computers, personal digital assistants (PDA's), mobile telephones and electronic books, newspapers, magazines, etc.

A display device of the type mentioned in the opening paragraph is known from international patent application WO 99/53373. That patent application discloses an electronic ink display comprising two substrates, one of which is transparent. The other substrate is provided with electrodes arranged in rows and columns. A crossing between a row and a column electrode is associated with a display element. The display element is coupled to the column electrode via a thin-film transistor (TFT), the gate of which is coupled to the row electrode. This arrangement of display elements, TFT transistors and row and column electrodes jointly forms an active matrix. Furthermore, the display element comprises a pixel electrode. A row driver selects a row of display elements and the column driver supplies a data signal to the selected row of display elements via the column electrodes and the TFT transistors. The data signal corresponds to graphic data to be displayed.

Furthermore, an electronic ink ("E-ink") is provided between the pixel electrode and a common electrode provided on the transparent substrate. The electronic ink comprises multiple microcapsules of about 10 to 50 microns. Each microcapsule comprises positively charged white particles and negatively charged black particles suspended in a fluid. When a negative field is applied to the common electrode, the white particles move to the side of the microcapsule directed to the transparent substrate, and the display element becomes visible to a viewer. Simultaneously, the black particles move to the pixel electrode at the opposite side of the microcapsule where they are hidden from the viewer. By applying a negative field to the pixel electrode, the black particles move to the common electrode at the side of the microcapsule directed to the transparent substrate, and the display element appears dark to a viewer. When the electric field is removed, the display device remains in the acquired state and exhibits a bi-stable character.

Grayscale in the display device images can be generated by controlling the amount of particles that move to the counter electrode at the top of the microcapsules. For example, the energy of the positive or negative electric field, defined as the product of field strength and time of application, controls the amount of particles moving to the top of the microcapsules.

Grayscales in electrophoretic displays are generally created by applying a voltage pulsed for specified time periods. They are strongly influenced by temperature, image history, dwell time, temperature, humidity, lateral inhomogeneity of the electrophoretic foils, etc.

Applicants' prior, copending application no. EP02078823.8, filed Sep. 16, 2002, which is incorporated in this application by reference in its entirety discloses that switching time in an E-ink type electrophoretic display decreases strongly with increasing temperature when the same driving voltage is applied. Hence, the length (i.e. the duration) of driving voltage pulse required at higher temperature is shorter for the same grayscale transition. It has been proposed in EP 02078823.8 to adjust the length of the driving voltage pulse according to the temperature at which the display operates. This result can be realized either by adjusting the number of frames or by directly adjusting the clock rate in the controller for different temperatures (while the number of frames remains the same). In the latter case, the frame time scales with clock rate. This is straightforward and useful especially when the minimum frame time used at (low) room temperature is not short enough. The grayscale accuracy will not be limited by the resolution of the frame time specified for low temperatures. It should be noted that the dwell time is the time between two subsequent image updates or the rest time between driving pulses.

To minimize the influence of image history and the dwell time, a new driving scheme was disclosed in applicant's prior, copending application no. EP02077017.8, filed May 24, 2002, which is incorporated herein by reference in its entirety, in which a preset signal (referred to in the present application as a pre-pulse) made up of a single preset pulse or series of preset pulses is applied just prior to the driving pulse based on a transition matrix table. The pre-pulses essentially eliminate the influence of dwell time. Simultaneously, the number of previous states is largely reduced after use of the pre-pulses. The grayscale accuracy is greatly improved. Application no. EP0207017.8 discloses a temperature sensor and temperature compensation provided to correct the drive signal for the actual operating temperature of the display device. Temperature compensation reduces the temperature dependency of the gray value reproduction of the display device.

A disadvantage of some conventional displays is that using a predetermined driving pulse, an increased dwell time often leads to an increased "underdrive", i.e. a darker than desired state is obtained for a switching from dark to bright and a brighter than desired state is achieved for a switching from bright to dark. The dwell time is in practice variable depending upon the usage model of the display and application. This limits the accuracy of the grayscales.

In one aspect of the present invention, an improved driving scheme for obtaining optimal picture and text quality and reaching more accurate grayscales is achieved by using progressively more pre-pulses at higher temperature. An increased number of pre-pulses or an increased length of pre-pulses relative to the driving pulse time is provided at an increased temperature. The grayscale accuracy is significantly improved by applying more pre-pulsing relative to the short driving time.

A way of implementing pre-pulses at different temperatures is to use a fixed number of preset pulses with a duration scaled with the length of driving pulse. i.e. a progressively shorter pre-pulse at higher temperatures. In this way, the grayscale accuracy is expected to increase with increased temperatures because of the high mobility of the ink material at high temperatures (supported by a shorter switching time).

It has been found, however, the grayscale accuracy decreases significantly with increased temperature. As a consequence, at a higher temperature, with a larger number of preset pulses forming a pre-pulse the desired optical state is achieved accurately despite the fact that the mobility is higher.

The underlying mechanism of pre-pulses is different from that of driving pulses. To realize a grayscale transition, the particles have to move for a large distance by using the driving pulse. The speed of the particle movement plays a dominant role in determining the switching time. The mobility of the particles is higher at higher temperature (presumably due to the decrease of viscosity of the liquid in which the particles move) resulting in a shorter switching time. However, the role of pre-pulses is to create some initial momentum for the particle movement by e.g. breaking the static contacts between particles. This requires only small distance movement so the mobility is not as essential. The total energy involved in the pre-pulses should, moreover be sufficiently high so that the energy barrier can be overcome to reach the required initial momentum.

Since the switching time at higher temperatures is shorter, the grayscale accuracy is more sensitive to the starting speed i.e. initial momentum. If the switching starts at optimal initial state, the grayscale error will be smaller. In contrast, the switching time at lower temperatures is long. The grayscale accuracy is less sensitive to the initial state because it will always get closer to the correct gray level when the time is sufficiently long.

An advantage of the invention is that it overcomes disadvantages of conventional displays, in particular of E-ink type electrophoretic displays, by providing a robust driving scheme to obtain optimal picture and text quality by varying the number and length of preset pulses relative to driving pulse time according to the temperature at which the display operates. For the purposes of this application, driving pulse time is the time over which a drive signal is applied to an electrode. The drive signal may include a reset pulse which returns the display element to an extreme (e.g., black or white) optical state.

A further advantage of the invention is that it provides a method of setting a drive signal for an electrophoretic display to obtain optimal picture and text quality.

These and still further advantages of the present invention will become apparent upon considering the following detailed description for the present invention.

FIGS. 3A-D are graphs of dwell time against grayscale error and voltage.

Figure 4:
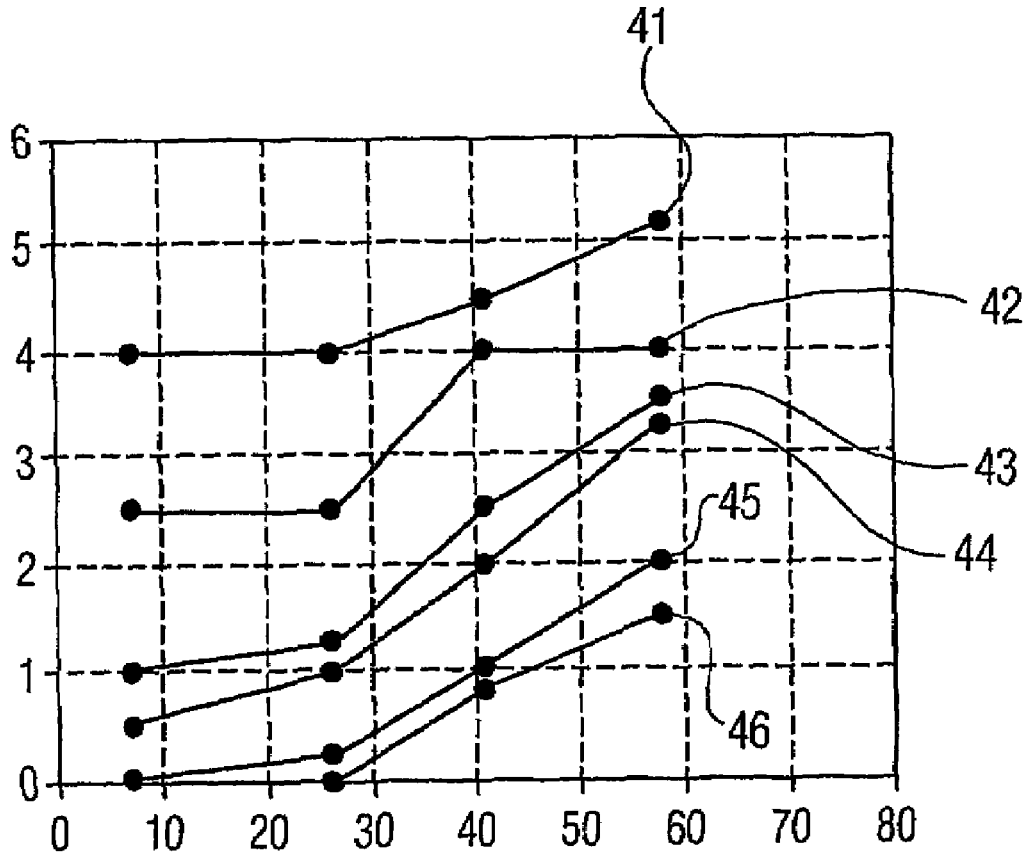

FIG. 4 is a graph of grayscale error for a transition in brightness from 32L* to 50L* against temperature for various numbers of preset pulses.

Figure 5:
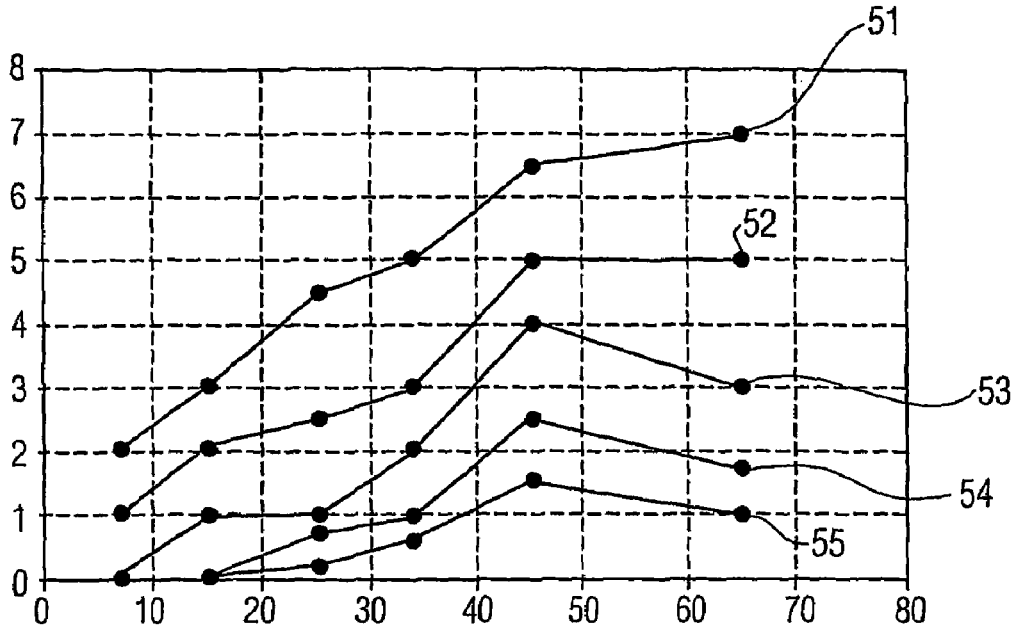

FIG. 5 is a graph of grayscale error for a transition in brightness from 30L* to 58L* against temperature for various numbers of preset pulses.

Figure 6:
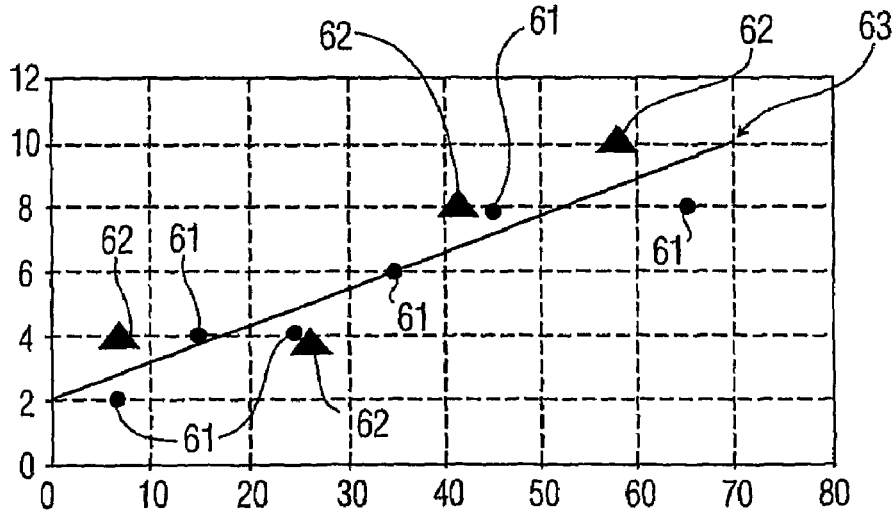

FIG. 6 is graph of the variation with temperature of the minimum number of preset pulses required to reach a desired grayscale.

Figure 7:
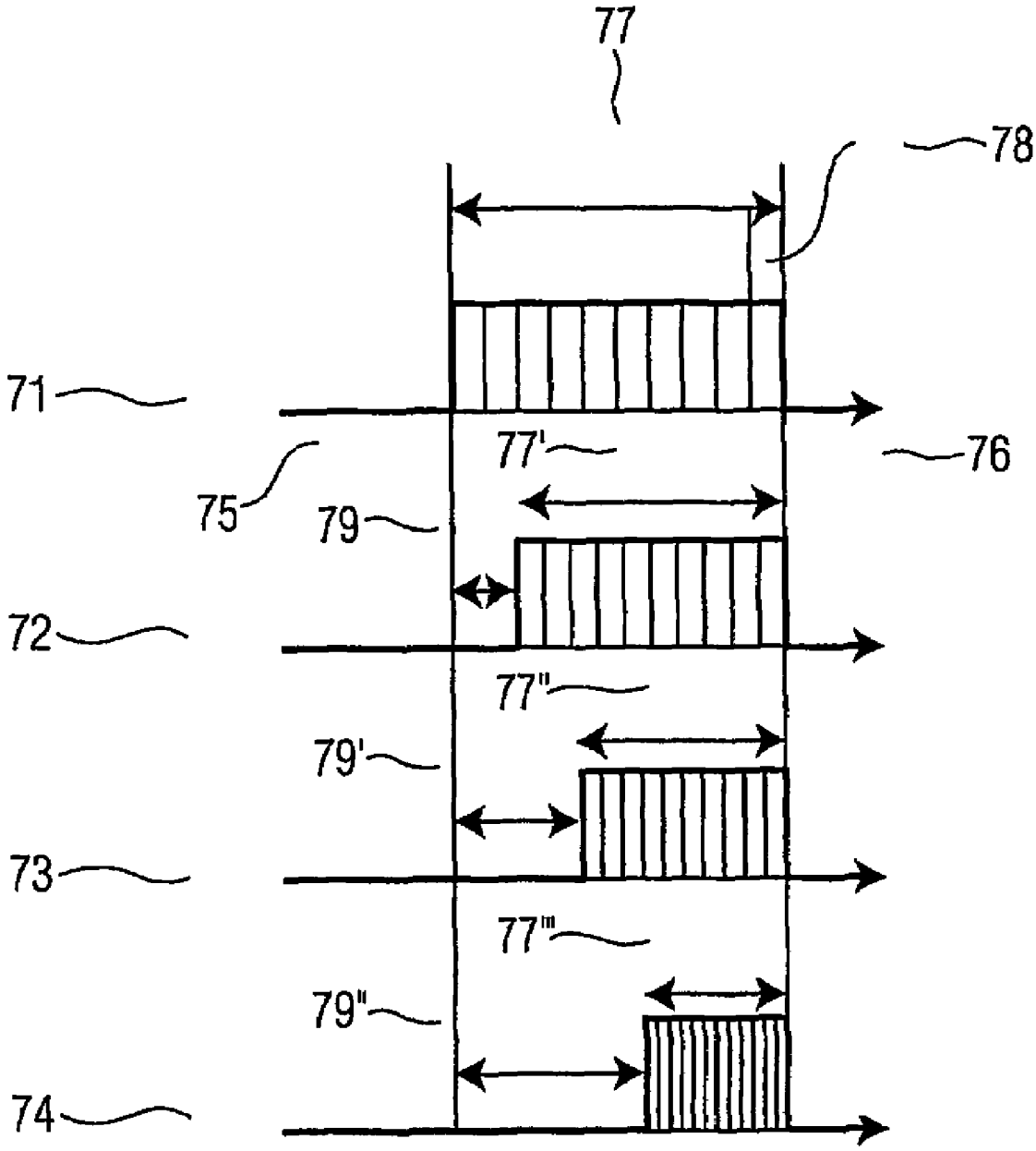

FIG. 7 is a schematic showing the increase in time available for pre-pulsing at higher temperatures.

Embodiments of the present invention are explained with reference to the attached drawings. The Figures are schematic and not drawn to scale, and, in general, like reference numerals refer to like parts.

Figure 1:
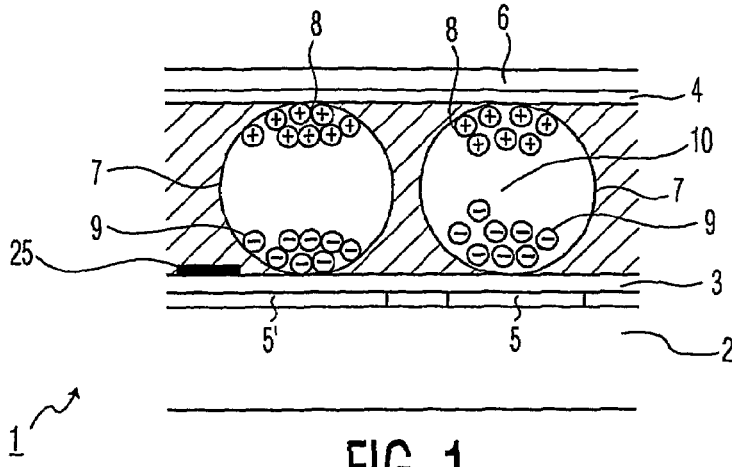
FIG. 1 is a diagrammatic cross-section of a portion of a display device.

FIG. 1 is a diagrammatic cross-section of a portion of an electrophoretic display device 1, for example of the size of a few display elements, comprising a base substrate 2, an electrophoretic film with an electronic ink which is present between two transparent substrates 3, 4 of, for example, polyethylene. One of the substrates 3 is provided with pixel electrodes 5, 5', which may not be transparent, and the other substrate 4 is provided with a transparent counter electrode 6. The E-ink comprises multiple microcapsules 7 of about 10 to 50 microns. Each microcapsule 7 comprises positively charged white electrophoretic particles 8 and negatively charged black electrophoretic particles 9 suspended in a fluid 10. When a positive field is applied to the pixel electrode 5, the white particles 8 move to the side of the microcapsule 7 directed to the pixel electrode 5, and the display element becomes visible to a viewer. Simultaneously, the black particles 9 move to the opposite side of the microcapsule 7 where they are hidden from the viewer. By applying a negative field to the pixel electrodes 5, the black particles 9 move to the side of the microcapsule 7 directed to the counter electrode 6, and the display element appears dark to a viewer. When the electric field is removed, the particles 8, 9 remain in the acquired state and the display exhibits a bi-stable character and consumes substantially no power.

A temperature sensor 25 measures a temperature indicative of the temperature of the display device 1, in particular of the fluid 10 and the microcapsules 7. The temperature sensor 25 is typically a silicon based sensor such as the LM75A digital temperature sensor from Philips Semiconductors, but may be a thermocouple or other temperature sensing device equipped with a transducer to transmit the temperature measurement in digital form to a processor 15 (shown in FIG. 2).

Figure 2:
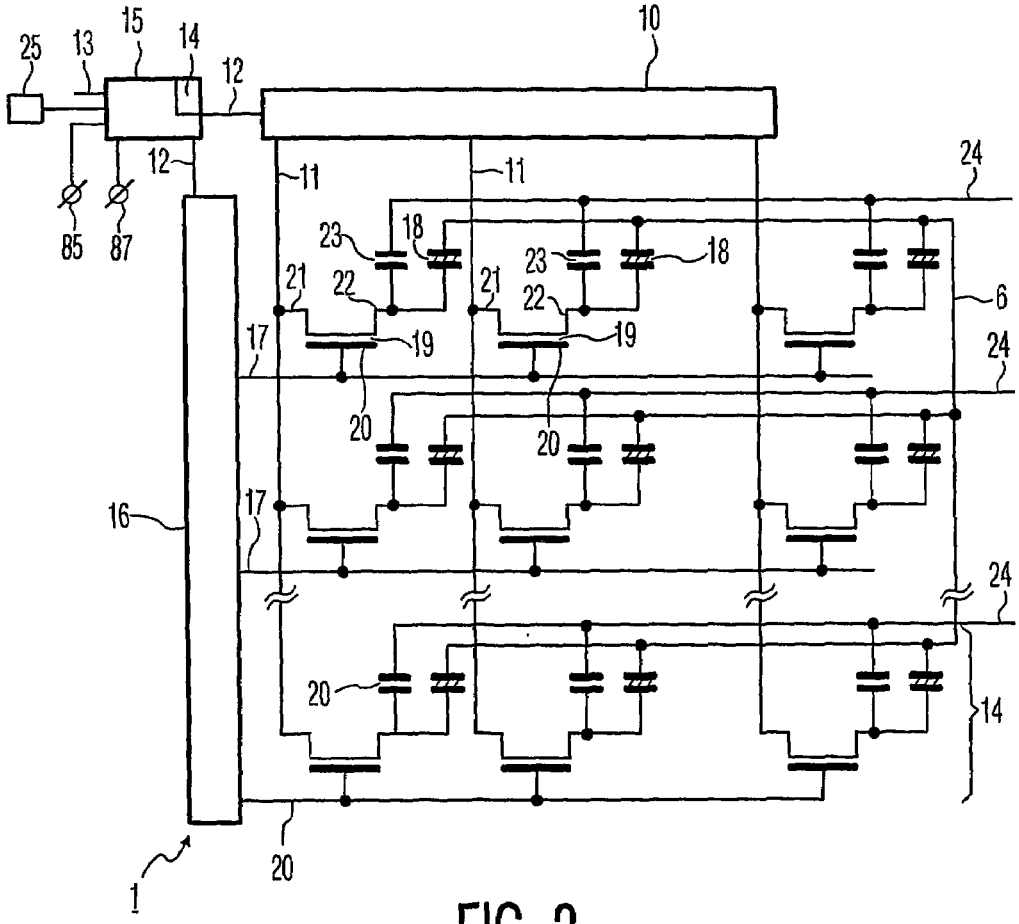
FIG. 2 is a circuit diagram of a portion of a display device.

FIG. 2 is an equivalent circuit diagram of a picture display device 1 comprising an electrophoretic film laminated on a base substrate 2 provided with active switching elements, a row driver 16 and a column driver 10. Preferably, a counter electrode 6 is provided on the film comprising the encapsulated electrophoretic ink, but could be alternatively provided on a base substrate in the case of operation with in-plane electric fields. The display device 1 is driven by active switching elements, in this example thin-film transistors 19. It comprises a matrix of display elements at the area of crossings of row or selection electrodes 17 and column or data electrodes 11. The row driver 16 consecutively selects the row electrodes 17, while a column driver 10 provides a data signal to the column electrode 11. A processor 15 first processes incoming data 13, including input from the temperature sensor 25 into the data signals, in particular, the pre-pulses and pre-pulse sequence of the present invention. Counter electrodes may be coupled to two outputs 85, 87 of the processor 15. Mutual synchronization between the column driver 10 and the row driver 16 takes place via drive lines 12. Select signals from the row driver 16 select the pixel electrodes 22 via the thin-film transistors 19 whose gate electrodes 20 are electrically connected to the row electrodes 17 and the source electrodes 21 are electrically connected to the column electrodes 17. A data signal present at the column electrode 17 is transferred to the pixel electrode 22 of the display element coupled to the drain electrode via the TFT. In the embodiment, the display device of FIG. 1 also comprises an additional capacitor 23 at the location of each display element 18. In this embodiment, the additional capacitor 23 is connected to one or more storage capacitor lines 24. Instead of TFT's, other switching elements can be used, such as diodes, MIM's, etc.

Figure 3A:
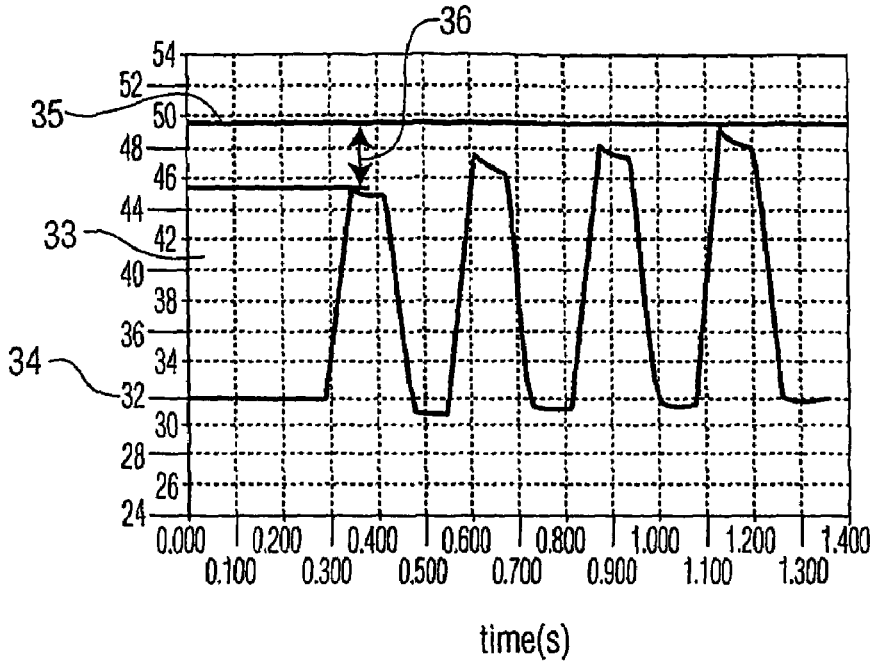
Figure 3B:
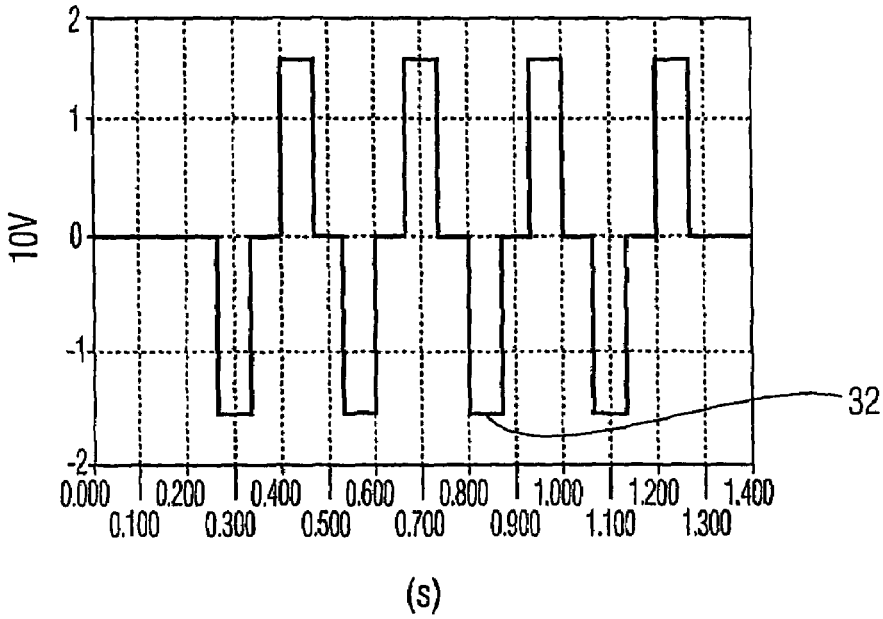
Figure 3C:
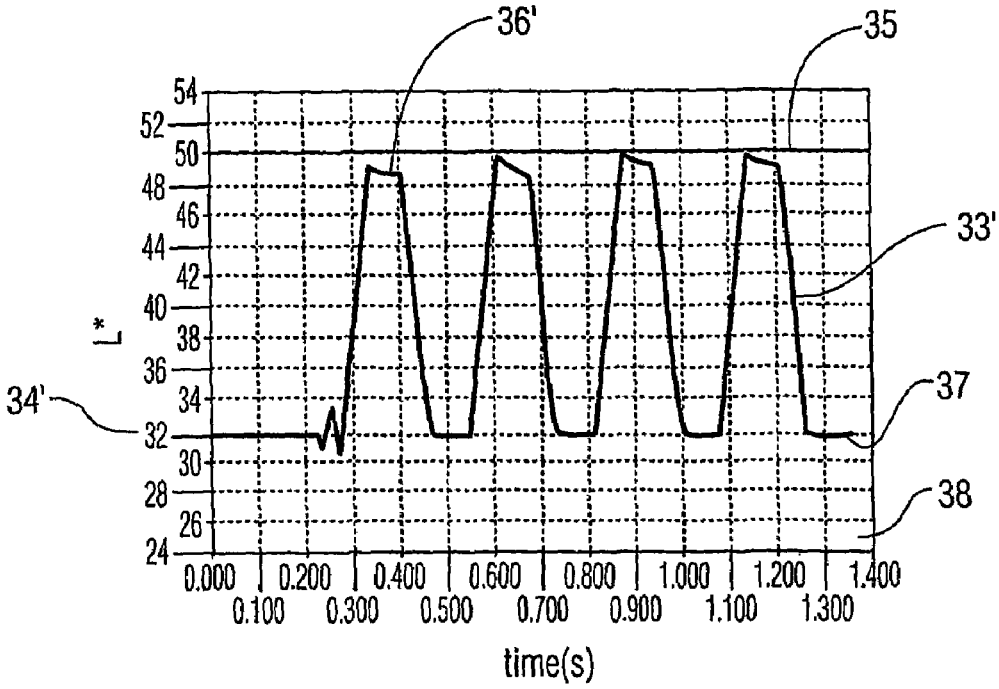
Figure 3D:
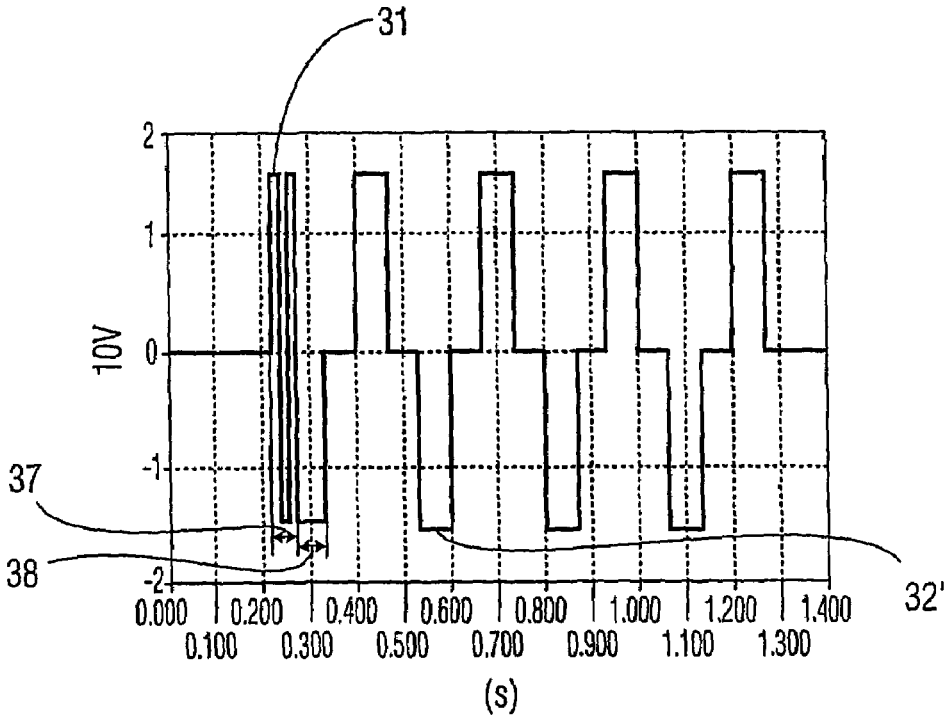

FIGS. 3A-D are diagrams of the typical behavior of an E-ink type electrophoretic display. FIGS. 3A and 3B are graphs of the display behavior without pre-pulsing. FIGS. 3C and 3D show the display behavior with pre-pulses 31. The experiment was carried out at 26° C. for a grayscale transition from 32L* to 50L* in device independent color space. FIGS. 3B and 3D show the driving pulses 32, 32' and IG.'s 3A and 3C show the corresponding optical responses 33, 33'. The x-axis of each graph shows time in seconds. The y-axis of the graphs in FIGS. 3B and 3D are voltage with one division equal to 10V. In FIGS. 3A and 3C, the y-axis is optical response expressed in L* (i.e. brightness or luminance) in the Commission Internationale de l'Eclairage (CIE) L*a*b* Color Space Model, in which L* ranges from 0 (black) to 100

(white). The initial dark gray state (32L*) 34, 34' is switched toward a light gray state (50L*) 35 by applying −15 V for 66 ms and then the voltage drops to zero for 66 ms, during which period the display remains at light gray state (bi-stable). The display is then switched to the dark gray state by applying the same pulse but positive voltage. This process is repeated four times. In the graph of the behavior without pre-pulsing (FIGS. 3A and 3B), the brightness after the first pulse is seen to be far below the desired target brightness 35, which is achieved only after the use of more than two pulses 32. This phenomenon was reproducible and called "underdrive" in Applicants' prior, copending application EP02078823.8, resulting from the dwell time. This grayscale error or $L^*_{error}$, (the gap 36, 36' in FIGS. 3A and 3C), is significantly reduced after using the pre-pulses 31. In this example, only four pre-pulses 31 are used with a length of 13.2 ms (the ratio between the pre-pulse time 37 and the driving time 38 is 1:5).

FIG. 3A is an example of the grayscale error ($L^*_{error}$) induced by dwell time and the significant improvement by applying a pre-pulse of four preset pulses (FIG. 3C), both measured at 26° C. The length of the driving voltage pulses is 66 ns for a transition from about 32L* to 50L* and the length of pre-pulse is 13.2 ms (20% of the driving time).

In FIG. 4 the grayscale error $L^*_{error}$ is plotted as a function of temperature for a grayscale transition from 32L* to 50L* with no pre-pulse (curve 41) and with 2, 4, 6, 8, 10 preset pulses (respectively, curves 42, 43, 44, 45, 46). The units on the x-axis in FIG. 4 are temperature in degrees Celsius; on the y-axis they are brightness in L*. The driving time at different temperatures is adjusted according to the temperature dependence of switching time and the ratio between the pre-pulse time and driving time is fixed at 1:5. Thus, the pre-pulse time is scaled with the driving time and is shorter at higher temperatures.

When no pre-pulse is used (curve 41), the grayscale error $L^*_{error}$ is unacceptably large (4L* or more) over the whole temperature range measured. As expected, the grayscale error is significantly reduced by applying pre-pulses; and it decreases with an increased number of preset pulses (comparing the data points at a constant temperature e.g. 26° C.).

When, however, the temperature varies from about 5 to 60° C., the grayscale error depends strongly on the operating temperature, especially at a temperature above 26° C. The grayscale error increases strongly with increasing temperature, although it would be expected that the grayscale error decreases with increasing temperature because of the increased mobility of the ink material at higher temperatures leading to a shorter switching time. So, a larger amount of pre-pulsing is required at higher temperatures to obtain a grayscale with an acceptable accuracy.

FIG. 5 shows the results of another experiment studying a grayscale transition from 30L* to 58L*. The grayscale error $L^*_{error}$ varies with temperature for the transition from 30L* to 58L* with 0, 2, 4, 6 and 8 preset pulses (respectively, curves 51, 52, 53, 54, 55 in FIG. 5). The units on the x-axis in FIG. 5 are temperature in degrees Celsius; on the y-axis they are brightness in L*. The driving time is adjusted according to the temperature and the pre-pulse time is at 20 ms. In this experiment, the length of pre-pulses is fixed at 20 ms at different temperatures and, thus, not scaled with the driving time. Since the driving time becomes shorter at higher temperatures, the ratio between the pre-pulse time and driving time increases with increasing temperature from 1:12 at 7° C. to 2.4:12 at 65° C. Now, the pre-pulse time is longer relative to the driving time at higher temperatures. Even so, the results are very similar to those observed in FIG. 4. Also, a larger number of preset pulses is required at higher temperatures to obtain a grayscale with an acceptable accuracy.

In FIG. 6 the minimum number of pre-pulse preset pulses required for reaching the desired grayscale with a maximum error of 1.5L* is shown for a range of temperatures and for two grayscale transitions, one in which the difference between $L^*_{final}$ and $L^*_{initial}$ was 28L*, the other in which the difference between $L^*_{final}$ and $L^*_{initial}$ was 18L*. In a practical display, the grayscale error is usually not visible when it is smaller than 1.5L*. The units on the x-axis in FIG. 6 are temperature in degrees Celsius; on the y-axis they are the number of preset pulses. The data points 61 are for a $L^*_{final}-L^*_{initial}$ transition of 28L*. The data points 62 are for a $L^*_{final}-L^*_{initial}$ transition of 18L*. The data is derived from FIGS. 4 and 5.

The line 63 in FIG. 6 indicates a trend. A clear increase is seen with an increased temperature. The required minimum number of preset pulses increases almost linearly with increasing temperature. This tendency is not sensitive to the choice of the ratio between the pre-pulse time and the driving pulse time within the studied range.

There are a number of embodiments that can achieve robust driving scheme for an electrophoretic display, for example, an E-ink type electrophoretic display, and obtain optimal picture and text quality by taking advantage of the grayscale error's being smaller if the switching starts at an optimal state and the grayscale's being more sensitive to this effect as temperature increases. The value of the potential difference applied by pre-pulses as temperature increases may increase absolutely or may increase relative to the potential difference applied by the driving pulse or both. Examples are:

EMBODIMENT 1

A larger value of potential difference applied by pre-pulses at higher temperatures can be determined by increasing the number of preset pulses with a pulse length scaled with the driving pulses. This is desirable when the clock rate is adjusted at different temperatures (i.e., the frame time is varying).

EMBODIMENT 2

A larger value of potential difference applied by pre-pulses at higher temperatures can be determined by increasing the length of preset pulses relative to the driving pulse time. This is desirable when the driving time becomes extremely short, e.g. at (extremely) high temperature.

EMBODIMENT 3

A larger value of potential difference applied by preset pulses at higher temperatures can be determined by increasing both the number and length of pre-pulses. This is also desirable when the driving time becomes extremely short, e.g. at (extremely) high temperature (a too short pulse may have insufficient energy to break the static contact between particles).

EMBODIMENT 4

A larger value of potential difference applied by pre-pulses at higher temperatures can be determined by increasing amplitude, i.e. the maximum voltage of one or more of the preset pulses.

EMBODIMENT 5

Yet another embodiment is shown in FIG. 7. Optimal use is made of the maximum time available for pre-pulsing within a fixed total image refresh time at different temperatures. The picture quality is then reasonably optimized, given the power rating, properties of the particular E-ink being used and other design parameters of the display, and the picture update rate is the same at different temperatures. The power consumption is, however, also increased.

FIG. 7 is a series of schematics of implementing pre-pulses at increasing temperatures $T_4>T_3>T_2>T_1$ (71, 72, 73, 74), according to embodiment 4 of this invention. The x-direction in the schematics represents time; the y-direction represents voltage. The maximum time available within a fixed image refresh time from time G0 to G1 (75 to 76 in FIG. 7) at different temperatures is optimally used. More time available at higher temperatures is suitable for more pre-pulsing. The driving time $t_a$ (77, 77', 77", 77''') and frame time $t_f$ 78 are decreased with temperature. The usable time for pre-pulsing, $t_p$, (79, 79", 79''') can then be increased, affording an opportunity to vary the number, amplitude and length of pre-pulses over a longer usable time for pre-pulsing.

Finally, the above-discussion is intended to be merely illustrative of the present invention and should not be construed as limiting the appended claims to any particular embodiment or group of embodiments. For example, the processor 15 may be a dedicated processor for performing in accordance with the present invention or may be a general-purpose processor wherein only one of many functions operates for performing in accordance with the present invention. The processor 15 may operate utilizing a program portion, multiple program segments, or may be a hardware device utilizing a dedicated or multi-purpose integrated circuit. Each of the systems utilized may also be utilized in conjunction with further systems. Thus, while the present invention has been described in particular detail with reference to specific exemplary embodiments thereof, it should also be appreciated that numerous modifications and changes may be made thereto without departing from the broader and intended spirit and scope of the invention as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference numerals in the claims are for illustration purposes only and do not limit the scope of the claims;

d) several "means" may be represented by the same item or hardware or software implemented structure or function; and e) each of the disclosed elements may be comprised of hardware portions (e.g., discrete electronic circuitry), software portions (e.g., computer programming), or any combination thereof.

The invention claimed is:

1. A display device comprising electrophoretic particles, a temperature sensor, a processor and a display element comprising two or more electrodes, the processor applying a driving pulse and a pre-pulse to one of said electrodes, a portion of the electrophoretic particles being present between the electrodes, the driving pulse being set to bring the display element to a predetermined optical state corresponding to image information to be displayed, the temperature sensor being configured to detect a temperature of the display device and transmit a temperature input corresponding to the detected temperature to the processor, the pre-pulse preceding the driving pulse and comprising one or more preset pulses, each said preset pulse transmitting an energy to the portion of the electrophoretic particles sufficient to release all or part of the portion of electrophoretic particles from a first position near one of said electrodes, said energy being too low to enable said all or part of the particles to reach a second position near the other one of said electrodes, the first position corresponding to a first optical state, the second position corresponding to a second optical state, and the processor increasing volt-milliseconds of relative potential difference applied by the preset pulse with respect to potential difference applied by the driving pulse, in response to an increase in the detected temperature.

2. The display device of claim 1 wherein the processor increases the potential difference applied by increasing the number of the preset pulses.

3. The display device of claim 1 wherein the processor increases the potential difference applied by increasing the duration of one or more of the preset pulses.

4. The display device of claim 1 wherein the processor increases the potential difference applied by increasing the number of the preset pulses and the duration of one or more of the preset pulses.

5. The display device claim 4 wherein the duration of the pre-pulse plus duration of the driving pulse is kept constant for increases in the detected temperature.

6. The display device of claim 1 wherein the processor increases the potential difference applied by increasing the maximum voltage reached by one or more of the preset pulses.

7. The display device of claim 1 wherein the processor increases the potential difference applied by increasing the maximum voltage reached by one or more of the preset pulses, by increasing the number of the preset pulses and by increasing the duration of one or more of the preset pulses.

8. The display device of claim 7 wherein the duration of the pre-pulse plus duration of the driving pulse is kept constant for increases in the detected temperature.

9. The display device of claim 1, wherein the driving pulse comprises a voltage pulse moving the portion of the electrophoretic particles to the predetermined optical state.

10. The display device of claim 1, wherein the driving pulse comprises a reset voltage pulse moving the portion of the electrophoretic particles to an extreme optical state.

11. The display device of claim 1, wherein the driving pulse comprises a reset voltage pulse and a driving pulse component, the reset voltage pulse moving the portion of the electrophoretic particles to an extreme optical state and the driving pulse component moving the portion of the electrophoretic particles to the predetermined optical state.

12. A display device comprising electrophoretic particles, a temperature sensor, a processor and a display element comprising two or more electrodes, the processor applying pre-pulses and driving pulses to one of said electrodes, a portion of the electrophoretic particles being present between the electrodes, the driving pulses being set to bring the display element to a predetermined optical state corresponding to image information to be displayed, the temperature sensor being configured to detect a temperature of the display device and transmit a temperature input corresponding to the detected temperature to the processor, each of the pre-pulses preceding a respective one of the driving pulses and comprising a number of preset pulses, each said preset pulse transmitting an energy to the portion of the electrophoretic particles sufficient to release all or part of the portion of electrophoretic particles from a first position near one of said electrodes, said energy being too low to enable said all or part of the particles to reach a second position near the other one of said electrodes, the first position corresponding to a first optical state, the second position corresponding to a second optical state, and the processor increasing the absolute value of volt-milliseconds of potential difference applied by the preset pulses in response to an increase in the detected temperature.

13. The display device of claim 12 wherein the processor increases the volt-milliseconds of potential difference applied by increasing the number of the preset pulses.

14. The display device of claim 12 wherein the processor increases the absolute value of the volt-milliseconds of potential difference applied by increasing the duration of one or more of the preset pulses.

15. The display device of claim 12 wherein the processor increases the absolute value of the volt-milliseconds of potential difference applied by increasing the number of the preset pulses and the duration of one or more of the preset pulses.

16. The display device of claim 15 wherein the duration of the pre-pulses plus duration of the driving pulses is kept constant for increases in the detected temperature.

17. The display device of claim 12 wherein the processor increases the absolute value of the volt-milliseconds of potential difference applied by increasing the amplitude of one or more preset pulses.

18. The display device of claim 12 wherein the processor increases the absolute value of the volt-milliseconds of potential difference applied by increasing the amplitude of one or more of the preset pulses, by increasing the number of the preset pulses and by increasing the duration of one or more of the preset pulses.

19. The display device of claim 18 wherein the duration of the pre-pulses plus duration of the driving pulses is kept constant for increases in the detected temperature.

20. The display device of claim 12, wherein the driving pulse comprises a voltage pulse moving the portion of the electrophoretic particles to the predetermined optical state.

21. The display device of claim 12, wherein the driving pulse comprises a reset voltage pulse moving the portion of the electrophoretic particles to an extreme optical state.

22. The display device of claim 12, wherein the driving pulse comprises a reset voltage pulse and a driving pulse component, the reset voltage pulse moving the portion of the electrophoretic particles to an extreme optical state and the driving pulse component moving the portion of the electrophoretic particles to the predetermined optical state.

23. A method of addressing data to an electrophoretic display device comprising:

detecting a temperature indicative of the display temperature; transmitting the temperature detected to a processor, the processor being configured to determine a pre-pulse of one or more preset pulses preceding a driving pulse, each said preset pulse transmitting an energy to a portion of electrophoretic particles of the display sufficient to release all or part of the portion of electrophoretic particles from a first position near a first one of at least two opposing electrodes in a display element of the electrophoretic display device and to transmit a driving pulse being set to bring the display element to a predetermined optical state corresponding to image information to be displayed, the driving pulse preceded with said pre-pulse, said energy being too low to enable all or part of the particles to reach a second position near a second one of the at least two electrodes, the first position corresponding to a first optical state, the second position corresponding to a second optical state; and determining the pre-pulse based upon the detected temperature so that a potential difference applied to the display element by the pre-pulse increases by volt-milliseconds of relative potential difference applied by the preset pulse with respect to potential difference applied by the driving pulse, as the detected temperature rises.

24. The method of claim 23 wherein the act of determining the pre-pulse based upon the detected temperature comprises increasing the number of the preset pulses as the detected temperature rises.

25. The method of claim 23 wherein the act of determining the pre-pulse based upon the detected temperature comprises increasing the duration of one or more of the preset pulses as the detected temperature rises.

26. The method of claim 23 wherein the act of determining the pre-pulse based upon the detected temperature comprises increasing the number of the preset pulses and increasing the duration of one or more the preset pulses as the detected temperature rises, keeping constant the duration of the pre-pulse plus the duration of transmission of the data.

27. The method of claim 23 wherein the act of determining the pre-pulse based upon the detected temperature comprises increasing the amplitude of one or more of the preset pulses as the detected temperature rises.

28. The method of claim 23 wherein the act of determining the pre-pulse based upon the detected temperature comprises increasing the number of the preset pulses, increasing the amplitude of one or more of the preset pulses and increasing the duration of one or more of the preset pulses as the detected temperature increases, keeping constant the duration of the pre-pulse plus the duration of transmission of the data.

29. The method of claim 23 wherein the act of determining the pre-pulse based upon the detected temperature comprises increasing the potential difference applied to the display element relative to a voltage applied to the electrodes for transmission of the data.

30. The method of claim 23 wherein the act of determining the pre-pulse based upon the detected temperature comprises increasing the absolute potential difference applied to the display element.

31. An electrophoretic display device comprising:

at least two opposing electrodes in a display element of the electrophoretic display device;

means for detecting a temperature indicative of the temperature of the display element;

means for determining a pre-pulse of one or more preset pulses preceding a driving pulse, each said preset pulse transmitting an energy to a portion of electrophoretic particles of the electrophoretic display device sufficient to release all or part of the portion of electrophoretic particles from a first position near a first one of the at least two opposing electrodes and for transmitting a driving pulse to bring the display element to a predetermined optical state corresponding to image information to be displayed, the data the driving pulse preceded with said pre-pulse, based upon the detected temperature so that a potential difference applied to the display element by the pre-pulse increases by volt-milliseconds of relative potential difference applied by the preset pulse with respect to potential difference applied by the driving pulse, as the detected temperature rises, said energy being too low to enable said all or part of the particles to reach a second position near a second one of the at least two electrodes, the first position corresponding to a first optical state, the second position corresponding to a second optical state;

means for delivering the pre-pulse to one of the at least two opposing electrodes.

32. An electrophoretic display device comprising:

at least two opposing electrodes in a display element of the electrophoretic display device;

means for detecting a temperature indicative of the temperature of the display element;

means for determining a driving pulse having a driving pulse duration and driving pulse potential difference;

means for determining a pre-pulse of one or more preset pulses preceding a driving pulse, each said preset pulse transmitting an energy to a portion of electrophoretic particles of the electrophoretic display device sufficient to release all or part of the portion of electrophoretic particles from a first position near a first one of the at least two opposing electrodes and for transmitting a driving pulse to bring the display element to a predetermined optical state corresponding to image information to be displayed, based upon the detected temperature so that a pre-pulse potential difference applied to the display element by the pre-pulse increases by volt-milliseconds relative to the driving pulse potential difference as the detected temperature rises said energy being too low to enable said all or part of the particles to reach a second position near a second one of the at least two electrodes, the first position corresponding to a first optical state, the second position corresponding to a second optical state; and means for delivering the driving pulse preceded by the pre-pulse to one of the at least two opposing electrodes.

* * * * *